United States Patent [19]

Morozov et al.

[11] 4,315,429

[45] Feb. 16, 1982

[54] METHOD OF DETERMINING DEFORMATION CHARACTERISTICS OF CONSTRUCTION MATERIALS AND SOIL

[76] Inventors: Viktor N. Morozov, prospekt Kosmonavtov, 31, kv. 29, Ukhta; Ilya A. Gimpelson, ulitsa Yaroslava Gasheka, 4, korpus 1, kv. 532; Vladislav M. Bogomolov, prospekt Energetikov, 72, korpus 1, kv. 38, both of Leningrad, all of U.S.S.R.

[21] Appl. No.: 122,620

[22] Filed: Feb. 19, 1980

[51] Int. Cl.[3] ..... G01N 33/24

[52] U.S. Cl. ..... 73/84

[58] Field of Search ..... 73/84, 790, 789, 81

[56] References Cited

U.S. PATENT DOCUMENTS 2,833,144 5/1958 Miller et al. ..... 73/84

3,481,188 12/1969 Mori ..... 73/84

*Primary Examiner*—Jerry W. Myracle

*Attorney, Agent, or Firm*—McAulay, Fields, Fisher, Goldstein & Nissen

[57] ABSTRACT

The method of determining the deformation characteristics of construction materials and soil includes placing a die of a predetermined diameter on a material being tested and subjecting this die to an increasing load. Owing to the deformation of the tested material, the die becomes displaced by a value equalling 0.03 to 10.0 diameters of the die. The displacement of the die is measured, whereafter the load applied to the die is relieved, and the displacement of the die due to the elasticity is measured. The disclosed method enables to reduce the cost of testing with the use of dies, as well as to reduce the cost of foundations, and to enhance the reliability of structures by using information on structural properties and the characteristics of soils.

7 Claims, 8 Drawing Figures

METHOD OF DETERMINING DEFORMATION CHARACTERISTICS OF CONSTRUCTION MATERIALS AND SOIL

FIELD OF INVENTION

The invention relates to the art of construction, and more particularly it relates to the methods of determining the deformation characteristics of construction materials and soil.

The invention can be used in engineering and geological studies related to various construction projects, such as dwelling projects and industrial buildings and structures, bridges, tunnels and subways, airfields and highways; in investigation of properties of rock, stone and like materials; in quality control of material properties in finished articles, structures and specimens; in testing the compactness of embankments, dams and weirs.

BACKGROUND OF INVENTION

There is known a method of determining the deformation characteristics by single-axis loading of a specimen and measuring its deformation, with a thoroughly prepared specimen having the load applied to its face surfaces. The test includes measuring the deformation of the specimen and registering the corresponding load. The outcome of the test is used to determine such deformation characteristics as the modulus of elasticity and the deformation modulus.

The known method would not enable determining the deformation characteristics of a material in a structure. Moreover, the method in certain cases involves errors, such as those associated with the testing of concrete, on account of the lack of sufficient consistence of the properties of concrete in specimens and in real-life structures, caused by unavoidable differences among the conditions of placing, compacting and setting of the concrete in specimens and structures.

A method not unlike the abovementioned one is the laboratory method of studying the deformation properties of soils, called the compression method. A soil specimen taken from a test pit or hole is placed into a compression device and subjected to a load. The varying load and the accompanying variation of the height of the specimen are used to evaluate the deformation properties of the soil being tested.

However, the handling and storage of a specimen, as well as the operation of placing the specimen into the testing device more often than not alter the properties of the soil, which affects the practical value of this known method. Moreover, not every kind of soil can be sampled as a specimen retaining the natural properties of the soil, and with some soils such specimens cannot be taken altogether.

Therefore, the practice of engineering and geological studies makes use of the so-called pressiometric, or pressure-metering method of field-testing of soils in situ. The method is based on introducing into a predrilled hole a bladder or cylinder readily deformable in the horizontal direction. The variation of the volume of this bladder or cylinder at specified values of the pressure supplied thereinto is used to determine the deformation properties of the soil in the horizontal direction. The method is valid in what concerns isotropic soils which are also expected to be secure enough to sustain the uncased walls of the borehole. In real life, however, we have to deal more often than not with anisotropic soils displaying different properties in the horizontal and vertical directions. The abovementioned pressiometric method might lead to considerable errors when used for investigating the properties of anisotropic soils.

The closest prior art of the present invention is the technique of testing the soil in situ, in a test pit or a borehole, with the use of dies (cf. "Field Methods of Investigating Construction Properties of Soils" by Y. G. Trofimenkov and L. N. Vorobkov, in Russian, *STROYIZDAT* Publishers, Moscow, 1974, p. 57).

The method includes preparing the testing area by providing either a test pit or a drilled hole, stripping the contact surface, placing a die, loading the die with an increasing load, measuring the displacement of the die and computing the deformation modulus for the rectilinear portion of the curve showing the relationship between the displacement of the die and the load.

The diameter of the testing die used in the present-day practice of engineering and geological studies by this technique may be from 300 mm (in a hole) to 800 mm (in a test pit).

However, the outcome of the test is significantly influenced by the initial conditions of the testing cycle, such as the initial loose contact between the soil and the bottom of the die, and also the affected structure and loosening of the soil within a certain volume, caused by the drilling of the hole.

Besides, the method is labor-consuming and takes considerable time for a single testing cycle, whereby it is predominantly used in the engineering practice only in cases where engineering and geological studies are conducted in association with some unique construction project.

Nevertheless, the problem of obtaining sufficient information on the deformation properties of a material or soil remains quite acute. When this information is available, it is possible, for instance, to reduce the cost of a structure or a building without affecting the degree of its practical reliability in service.

The assessment of the joint and interrelated work of ground-supported structures, the foundation and the soil base enables to arive at the best possible engineering solution. With sufficient information available, the adverse effect of non-uniform sagging of the soil foundation may be positively minimized, which enables to require less of the shielding and guarding structures; the heat- and sound-insulating properties of the structure may be enhanced, and the level of the strained state in statically indeterminable load-supporting structures may be reduced.

Furthermore, dependable information on the deformation properties of the soil at the base of a structure enables in most cases to have higher service loads applied to this base of the structure.

BRIEF DESCRIPTION OF INVENTION

It is an object of the present invention to provide a method of determining the deformation characteristics of construction materials and soil with the use of a die, which method, owing to making use of that portion of the relationship between the displacement of the die and the load applied thereto which is practically unaffected by the contact, engagement and extreme conditions of the testing, should make it possible to improve the efficiency of the testing with the die, the accuracy and the scope of the information obtained on the deformation characteristics of a material in the practice of conducting engineering and geological studies.

This and other objects are attained in a method of determining the deformation characteristics of construction materials and soil, including placing a die on the material being tested, applying a load to the die to cause its displacement due to deformation of the tested material, measuring the displacement of the die and using the obtained data to calculate the deformation modulus of the material, in which method, in accordance with the invention, the die of a predetermined diameter is subjected to an increasing load to ensure its displacement by a value equalling 0.03 to 10.0 diameters of the die, whereafter the load applied to the die is gradually relieved, and the displacement of the die due to the elasticity is measured.

When the die is used for testing construction materials, it is expedient to subject it to a load to ensure its displacement by a value equalling 0.03 to 0.3 diameter of the die.

When the die is used for testing a homogeneous layer of the soil semispace, it is expedient that its displacement should equal 0.05 to 1.0 diameter of the die.

When a vertically non-homogeneous layer of the soil semispace is tested, it has been found expedient to subject the die to a load causing its displacement by a value equalling 0.2 to 1.0 diameter of the die, then to displace the die at a rate of 0.001 to 1.0 m/s, while continuously registering the resistance of the layer over a distance of 1.0 to 10 diameters of the die, and then to relieve the load applied to the die and to measure the displacement of the die one to the elasticity.

It is further expedient, while using a die for testing both homogeneous and non-homogeneous layers of the soil semispace, to select the die diameter according to the formula:

$$d \geqq \sqrt[3]{k_1 d_1}$$

where

"d" is the die diameter;

"$k_1$" is a constant factor;

"$d_1$" is the diameter of the weighted mean particles of the soil, where $d_1 \leqq 0.02$ m.

When the deformation characteristics of sandy well-filtering media are determined, it is expedient to displace the die at a 0.01 to 5.0 m/s rate through a distance equalling 0.2 to 10.0 diameters of the die.

When material specimens and structural elements of small transverse dimensions are tested, it is expedient to cause the displacement of the die through a distance equalling 0.03 to 1.0 diameter of the die, while limiting the development of the active zone of deformation to the range of values satisfying the limiting condition:

$$0.15\ L \leqq D \leqq 1.0\ L,$$

where "L" is the minimum dimension of the specimen, or the thickness of the structural element;

"D" is the maximum dimension of the active zone of deformation.

The employment of the present invention opens the possibility of avoiding the influence of substantial values of non-uniform sagging of the soil base or foundation on the strained state of above-ground and underground structures. The reduced level of the strained and deformed state caused by non-uniform sagging enables to use lighter structures. Obtaining information on the deformation properties of the soil and material of a structure in a sufficient scope provides for rationalized designing of foundations and for reducing their cost, while at the same time enhancing the service reliability of shielding, guarding and load-supporting structures. The method enables to essentially save the time and cost of engineering and geological studies, as compared with the conventional field method of determining the deformation modulus of soils.

The disclosed method further simplifies the process of determining the deformation characteristics of a material of both a specimen and a real-life structure.

DETAILED DESCRIPTION OF INVENTION

The invention will be further described in connection with embodiments thereof, with reference to the appended illustrative drawings, where:

FIGS. 3*a* to 3*f* disclose general arrangements of the apparatus for use in carrying out the method together with other general arrangements of the die and the load.

Practical performance of the method opens with preparing the testing site. When structural elements, material specimens or soil are tested, the preparation of the testing site includes selecting the testing site and thoroughly cleaning or stripping by various known per se techniques a portion of the surface which is to be engaged by the die.

Figure 3A:
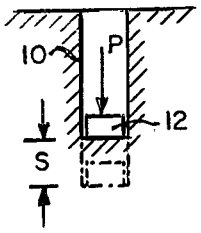

Reference is made to FIG. 3*a* which shows a site with a bore hole 10 dug into the soil and a die 12;

When the material, e.g. concrete, or the soil is to be tested at a certain depth, there is drilled a hole 10, FIG. 3*a*, and the face of the hole is prepared for the testing.

Figure 1:
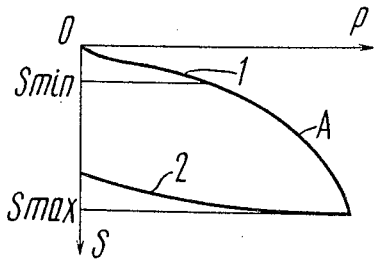
FIG. 1 shows the relationship between the displacement of the die and the load, in accordance with the invention.

The testing process includes loading the tested material, or else the tested medium, e.g. the semispace, the structural element or a specimen, and plotting the curve of the displacements of the die "12" (FIG. 1) versus the load "P". For processing the experimentally obtained data there is used the portion "A" of the curve of the displacement "S" of the die versus the load "P", limited by the coordinates $S_{min}$ and $S_{max}$, where $S_{min}$ is the minimum values of the displacement of the die, used for determining the deformation characteristic, and $S_{max}$ is the maximum value of the displacement of the die, attained during the test.

Any point of this curve within the portion "A" may be used for determining the deformation characteristics, i.e. the deformation modulus by the curve "1" of loading the die, and the elasticity modulus by the curve "2" corresponding to relieving the load of the die.

The accuracy of determining the deformation characteristics is enhanced when the level of the strained state of the medium, created by the loaded die, is increased.

The range of the displacement "S" of the die, usable for processing the outcome of the testing, is predetermined by the quality of preparing the engagement surface, the type of the material or soil, and its state, and may vary within broad limits, i.e.

$$0.03\ d \leqq S \leqq 0.3\ d,$$

when construction material in a structural specimen is tested, $$0.05\ d \leqq S \leqq 1.0\ d,$$

when homogeneous layers of the soil semispace are tested, or $$0.2\ d \leqq S \leqq 1.0\ d,$$

when non-homogeneous layers of the soil semispace are tested, where "d" is the diameter of the test die.

The above values have been found as an outcome of conducted experiments.

The conducted experimental testing has also enabled to find the preferable die diameter for testing homogeneous and non-homogeneous soil layers, which can be selected according to the formula:

$$d = \sqrt[3]{K_1\, d_1}\ ,\ \text{with}\ /\ d_1 \leqq 0.02\ m\ /,$$

where

"d" is the die diameter,

"$d_1$" is the diameter of the mean weighted soil particles,

"$k_1$" is a constant factor.

Figure 2:
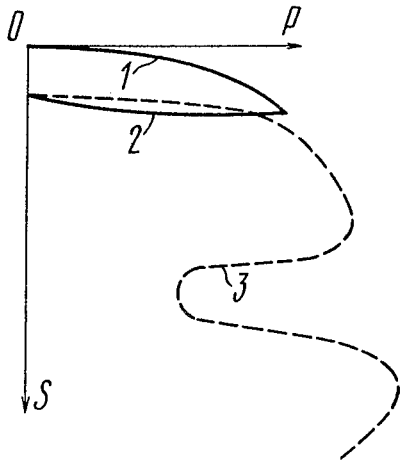
FIG. 2 shows the relationship between the displacement of the die and the load during the testing, and the dependance of the varying resistance of the medium on the depth, in accordance with the invention.

To determine the law of variation of the modulus of deformation of the soil semispace which is non-homogeneous depth-wise of the soil layer, the testing of the roof or top of the layer is followed by displacing the die at a 0.001 to 0.1 m/s rate, while continuously measuring the resistance of the layer, through the range "3" (FIG. 2) of the displacement "S", equalling 1.0 to 10.0 diameters of the die.

Figure 3B:
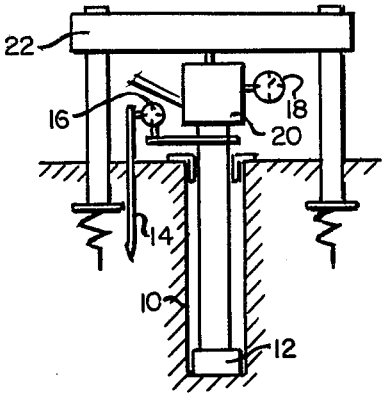
Figure 3C:
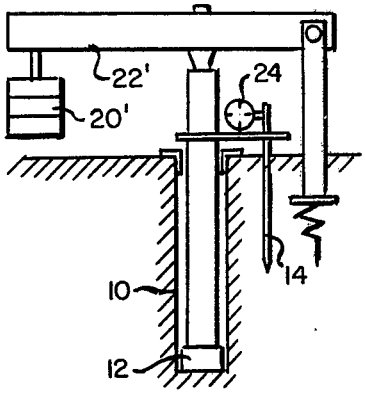

FIGS. 3*b* and 3*c* illustrate two different apparatus for testing the soil semispace. In FIG. 3*b*, probe 14 is connected with meter 16 to obtain a reading of the top soil and meter 18 is connected with load device 20 for applying the loading to die 12, all of which are supported by frame 22. In FIG. 3*c*, the reference numerals indicate like parts and similar parts are primed; a single meter 24 is here used to provide for direct readout of a comparison between the top soil reading obtained from probe 14 and die 12.

The limitation of the displacement "S" of the die by 1.0 to 10.0 diameters of the die is explained by the fact that within this range of the displacement "S" of the die being pressed-in, the walls of the hole 10, FIG. 3*a* impressed by the moving remain adequately stable, or self-sustained.

When sandy, well-filtering soils are being tested, the testing rate can be substantially increased, so that the die can be displaced at a 0.5 to 5.0 m/s rate to a depth equalling 0.2 to 10.0 diameters of the die.

The above limits and ranges have been determined by experimental studies.

Figure 3D:
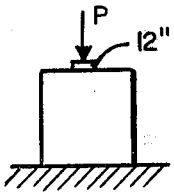
Figure 3E:
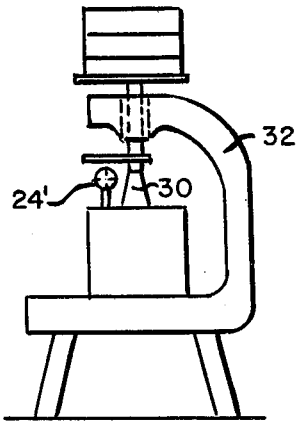
Figure 3F:
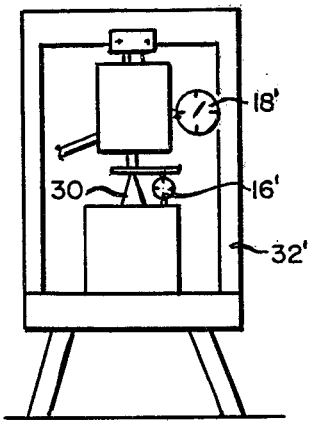

In FIG. 3*d*, a test specimen 30 is used in connection with die 12". FIGS. 3*e* and 3*f* illustrate two related apparatus 32 and 32' for testing speciment 30. FIG. 3*e* shows apparatus 32 with a single meter 24' and FIG. 3*f* shows apparatus 32' with two meters 16' and 18'.

When the material being tested is of small dimensions, e.g. the specimen 30 or an element of a real-life structure, it has been found expedient to conduct the testing with the die 12 displaced to 0.3 to 1.0 its diameter, and the development of the active deformation zone "D" limited, as follows:

$$0.15\ L \leqq D \leqq 1.0\ L,$$

where "D" is the maximum dimension of the active deformation zone;

"L" is the thickness of the structural element, or else the minimum dimension of the specimen;

0.15 L is the lower limit of the development of the active deformation zone.

When the testing is conducted to collect statistical data, 1.0 L is the upper limit of the development of the active deformation zone.

In any case, the observance of the upper limit ensures the integrity of the structural element or specimen.

The present invention will be further illustrated by examples of its implementation proving its feasibility and containing the data obtained by testing construction materials and soils.

In the present disclosure, construction materials are artificial and natural materials used in load-supporting and auxiliary structures of various buildings and the like, such as concrete, ceramic materials, bricks, lime, marble, gypsum.

EXAMPLE 1

Concrete in a structure was tested. The data of the testing with a die 8 mm in diameter are given in Table 1.

TABLE 1

| Load on Die, MN/m$^2$ | 16 | 32 | 48 | 64 | 80 | 96 | 112 | 80 | 48 | 16 | 0 |
|---|---|---|---|---|---|---|---|---|---|---|---|
| Die Displacement, mm | 0.052 | .080 | .138 | .204 | .286 | .388 | .53 | .52 | .49 | .46 | .41 |

The processing of the test data enabled to determine from the curve "1" (FIG. 1) of loading the die (16–112 MN/m$^2$) the modulus of deformation of the concrete, and from the load-relieving curve "2" (FIG. 1), within the 112-0 MN/m$^2$ range, the elasticity modulus of the concrete.

In the course of the testing the development of the deformation zone was monitored by calculations to ensure the integrity of the structure.

EXAMPLE 2

A brick was tested with a die of a 3.6 mm diameter. The test data are given in Table 2.

TABLE 2

| Load on Die, MN/m$^2$ | 120 | 240 | 360 | 480 | 360 | 240 | 120 | 0 |
|---|---|---|---|---|---|---|---|---|
| Die Discplacement, mm | 0.08 | .15 | .41 | .73 | .72 | .69 | .66 | .61 |

The processing of the data obtained by the test enabled to determine from the curve "1" (FIG. 1) of loading the die (0–480 MN/m$^2$) the modulus of deformation, and from the curve "2" (FIG. 1) of relieving the load (480-0 MN/m$^2$) the modulus of elasticity.

EXAMPLE 3

A gypsum specimen, as exemplified by 30, FIG. 3*d*, was tested with a die 3.6 mm in diameter. The test data are given in Table 3.

TABLE 3

| | | | | | | |
|---|---|---|---|---|---|---|
| Load on Die, $MN/m^2$ | 80 | 160 | 240 | 160 | 80 | 0 |
| Die Displacement, mm | 0.07 | .32 | .86 | .84 | .80 | .74 |

The processing of the data obtained by the test enabled to determine from the curve "1" (FIG. 1) of loading the die (0–240 $MN/m^2$) the modulus of deformation, and from the curve "2" of relieving the load (240-0 $MN/m^2$) the modulus of elasticity of the gypsum.

EXAMPLE 4

Porous sandstone was tested with a die 3.6 mm in diameter. The test data are given in Table 4.

TABLE 4

| | | | | | | | | |
|---|---|---|---|---|---|---|---|---|
| Load on Die, $MN/m^2$ | 90 | 180 | 270 | 360 | 270 | 180 | 90 | 0 |
| Die Displacement, mm | 0.21 | .38 | .55 | .68 | .66 | .63 | .59 | .54 |

The processing of the data obtained by the test enabled to determine from the curve "1" (FIG. 1) of loading the die (0–360 $MN/m^2$) the deformation modulus, and from the curve "2" of relieving the load (360-0 $MN/m^2$) the elasticity modulus of the sandstone.

EXAMPLE 5

Marble was tested with a die 3.6 mm in diameter. The test data are given in Table 5.

TABLE 5a

| | | | | | | | | |
|---|---|---|---|---|---|---|---|---|
| Load on Die, $MN/m^2$ | 150 | 300 | 450 | 600 | 450 | 300 | 150 | 0 |
| Die Displacement, mm | 0.07 | .11 | .21 | .38 | .38 | .37 | .36 | .34 |

The processing of the test data enabled to determine from the curve "1" (FIG. 1) of loading the die (0.–600 $MN/m^2$) the deformation modulus, and from the curve "2" of relieving the load (600-0 $MN/m^2$) the elasticity modulus of the marble.

EXAMPLE 6

Limestone was tested with a die 3.6 mm in diameter. The test data are given in Table 6.

TABLE 6

| | | | | | | | | |
|---|---|---|---|---|---|---|---|---|
| Load on Die, $MN/m^2$ | 200 | 400 | 600 | 800 | 600 | 400 | 200 | 0 |
| Die Displacement, mm | 0.08 | .13 | .18 | .29 | .27 | .26 | .24 | |

The processing of the test data enabled to determine from the curve "1" (FIG. 1) of loading the die (0–800 $MN/m^2$) the deformation modulus, and from the curve "2" of relieving the load (800-0 $MN/m^2$) the elasticity modulus of the limestone.

EXAMPLE 7

Organic glass was tested with a die 3.6 mm in diameter. The test data are given in Table 7.

TABLE 7

| | | | | | | |
|---|---|---|---|---|---|---|
| Load on Die, $MN/m^2$ | 100 | 200 | 300 | 200 | 100 | 0 |
| Die Displacement, mm | 0.11 | .25 | .58 | .56 | .51 | .43 |

The processing of the test data enabled to determine from the curve "1" (FIG. 1) of loading the die (0–300 $MN/m^2$) the deformation modulus, and from the curve "2" of relieving the load (300-0 $MN/m^2$) the elasticity modulus of the organic glass.

EXAMPLE 8

A glass-fibre plastic was tested with a die 5 mm in diameter. The test data are given in Table 8.

TABLE 8

| | | | | | | | | | | | |
|---|---|---|---|---|---|---|---|---|---|---|---|
| Load on Die, $MN/m^2$ | 30 | 50 | 70 | 90 | 110 | 90 | 70 | 50 | 30 | 10 | 0 |
| Die Displacement mm | 0.05 | .158 | .388 | 1.105 | 2.15 | 2.15 | 2.14 | 2.12 | 2.08 | 2.02 | 1.93 |

The processing of the test data enabled to determine from the curve "1" (FIG. 1) of loading the die (0–110 $MN/m^2$) the deformation modulus, and from the curve "2" of relieving the load (110-0 $MN/m^2$) the elasticity modulus of the plastic.

Given hereinbelow are the test data obtained at testing soils: sands loam, clay. It has been found that any sandy or clayey soil, of any density and strength are susceptible to the testing.

EXAMPLE 9

A homogeneous layer or formation of soil at a 2-meter depth was tested. A die 0.057 m in diameter was used for the testing. The test data are given in Table 9.

TABLE 9

| | | | | | | | | | | |
|---|---|---|---|---|---|---|---|---|---|---|
| Load on Die, $MN/m^2$ | 0.2 | 0.4 | 0.6 | 0.8 | 1.0 | 1.2 | 1.4 | 1.0 | 0.6 | 0 |
| Die Displacement, mm | 3.5 | 5.1 | 6.2 | 8.95 | 14.3 | 26.5 | 45 | 45 | 44.0 | 42.6 |

The processing of the test data enabled to determine from the curve "1" (FIG. 1) of loading the die (0–1.4 $MN/m^2$) the deformation modulus, and from the curve "2" of relieving the load (1.4–0 $MN/m^2$) the elasticity modulus of the soil.

EXAMPLE 10

Non-homogeneous in the depth-wise direction loam was tested with a die 0.057 m in diameter. The test data are given in Tables 10, 11 and 12 below.

TABLE 10

| | | | | | | | | | |
|---|---|---|---|---|---|---|---|---|---|
| Load on Die, $MN/m^2$ | 0.2 | 0.4 | 0.6 | 0.8 | 1.0 | 1.2 | 0.8 | 0.4 | 0 |

TABLE 10-continued

| | | | | | | | | | |
|---|---|---|---|---|---|---|---|---|---|
| Displacement of Die, mm | 9.5 | 15.0 | 18.1 | 21.2 | 26.5 | 40.6 | 40.7 | 40.2 | 37.5 |

The successive stage of the testing cycle included advancing the die at a 0.02 m/s rate and registering the resistance of the loam in the course of this advance. The data obtained at the second stage are given in Table 11.

TABLE 11

| | | | | | | |
|---|---|---|---|---|---|---|
| Displacement of Die, mm | 120 | 210 | 310 | 420 | 530 | 610 |
| Resistance of Loam (MPa) | 1.37 | 1.5 | 1.62 | 1.48 | 1.25 | 1.22 |

The third stage included relieving the load applied to the die and measuring its displacement due to the elasticity. The test data are given in Table 12.

TABLE 12

| | | | | | | | |
|---|---|---|---|---|---|---|---|
| Load on Die, MPa | 1.22 | 1.0 | 0.8 | 0.6 | 0.4 | 0.2 | 0 |
| Displacement of Die, mm | 610 | 612 | 612 | 611.8 | 611.3 | 610.7 | 610 |

The processing of the test data enabled to determine from the curve "1" (FIG. 1) of loading the die, as shown in Table 10 (0–1.2 MN/m$^2$), the deformation modulus, from the Table 11 the law of variation of the deformation modulus within the tested range of the depths of the formation under test, and from the curves "2" (FIG. 1) of relieving the load as shown in Table 10 (1.2–0 MN/m$^2$) and in Table 12 (1.22–0 MPa), the elascticity modulus of the loam.

EXAMPLE 11

Clay shale was tested as a specimen, as exemplified in FIG. 3*f* sampled from a 900-meter depth, with a die 20 mm in diameter. The test data are given in Table 13.

TABLE 13

| | | | | | | | | |
|---|---|---|---|---|---|---|---|---|
| Load on Die, MN/m$^2$ | 40 | 80 | 120 | 160 | 120 | 80 | 40 | 0 |
| Die Displacement, mm | 0.4 | 0.9 | 2.0 | 3.6 | 3.6 | 3.55 | 3.48 | 3.35 |

The processing of the test data enabled to determine from the curve "1" (FIG. 1) of loading the die (0–160 MN/m$^2$) the deformation modulus, and from the curve "2" of relieving the load (160–0 MN/m$^2$) the elasticity modulus of the clay shale.

EXAMPLE 12

A sand formation was subjected to a rapid test at a 5-meter depth with a dia 80 mm in diameter by applying an impact load as exemplified in FIG. 3*a*. Table 14 below gives the data illustrating the relationship between the displacement of the die and the applied load.

TABLE 14

| | | | | | |
|---|---|---|---|---|---|
| Load on Die, MN/m$^2$ | 2 | 4 | 5 | 5.8 | 0 |
| Die Displacement, mm | 2 | 3.2 | 6 | 57 | 53 |

With the known values of the impact energy, of the impact-delivering mass, of the die mass and of the mass of the rods, and of the die residual displacement value, the value of the modulus of deformation of the sand can be determined.

The different values of the lower limit of the die displacement, given hereinabove as 0.03 die diameter for construction materials, 0.05 for homogeneous soil and 0.2 die diameter for non-homogeneous soil, can be explained, as follows.

In case fo construction materials, it is easier to prepare a quality die-engaged surface, than it is in case of soils. Furthermore, when soils are tested, e.g. in a borehole, the outcome of the test is influenced by the technique of making the hole in the soil.

In case of non-homogeneous soils, the lower limit of the die displacement, given hereinabove as 0.2 die diameter, provides for obtaining averaged characteristics, owing to the development of an essential deformation zone.

The upper limit of the die displacement, given hereinabove as 0.3 die diameter for construction materials, is explained by the fact that there exists the hazard of transition of the interaction of the die and the tested material from the pattern of deformation strengthening to that of plastic destruction, with the development of common slippage surfaces.

The upper limit of 1.0 die diameter given hereinabove for homogeneous soils is explained by the fact that any subsequently obtained information is of no practical value.

The upper limit given hereinabove for non-homogeneous soils is explained by the fact that subsequent displacement yields data which is difficult to interpret analytically.

The range of the die displacement rates in sandy soils, given hereinabove as 0.01 to 5.0 m/s does not affect the outcome of the soil testing.

The range of the die displacement rates in cohesive soils, given hereinabove as 0.001 to 0.1 m/s is explained by the feasibility of performing the method with the existing technical means.

Testing of soils in situ with test loading is nowadays the most trustworthy technique of determining the deformation modulus of the soil.

Dies 300 to 800 mm in diameter which are employed for testing the soil in the present-day practice of construction to attain the standard values of deformability curb down the applicability of the field-testing technique on account of the poor efficiency, high costs and complicated testing routine. For this reason, the employment of such dies has been practically limited to testing the foundation soil of the most important buildings and structures. In the rest of practical cases, the information lacking for calculations has been obtained as the data of compression, stabilometry, pressiometry, penetration, probing and other soil-testing techniques. Quite naturally, the accuracy of determining the required characteristic has been significantly affected, which eventually has resulted in increased construction costs.

The outcome of conducted investigations and studies shows that the deformation properties of the soil are of more essential value for forecasting the interaction of the structure and its foundation soil, than it has been heretofore considered in the engineering design practice. Thus, it appears that in case of sandy and some other soils it is possible to forecast the relationship between the dissplacement of various foundations and a load varying within a broad range, if the law governing the variation of the deformation modulus with the depth has been established.

The herein disclosed method of testing soil in situ under field conditions with small-diameter dies in order to determine the deformability of the soil medium makes it possible to test sand, loam and clay soils of any density and strength.

The substantial reduction of the diameter of the testing die, as compared with the diameter of dies used nowadays in the practice of engineering and geological studies, enables to drill holes of an essentially smaller diameter, i.e. to have a lightweight casing and drilling rigs of a relatively small power output.

The disclosed method provides for stepping up the accuracy of determining the deformation modulus, owing to avoiding the influence of the drilling-affected structure of the soil, and of the initial conditions of testing. The conventional method of the prior art is practically limited to having the dies sagging by values of the several-millimeter magnitude, so that poor engagement of the bottom of the die with the face of the hole and the drilling-affected soil structure are capable of introducing significant errors into the determination of the deformation modulus. The influence of the said factors is minimized in the herein disclosed method, owing to the utilization of the non-linear portion of the curve of the displacement "S" (FIG. 1) of a small-diameter die versus the load "P", as well as to have the values of the sagging as high as several dozen millimeters. The portion of the curve used for processing the test data is the one reflecting the deformation-strengthening of the soil.

The reduction of the testing die diameter and the use of the outcome of specific studies make it possible to conduct 50 to 100 testing cycles per month instead of 2 to 5. The information obtained by such testing cycles enables to arrive at the optimized solution of the problem of transferring the load from a structure to its foundation soil.

The reduced diameter of the testing die essentially simplifies the testing technique, owing to the reduced value of the total load required and to the reduced testing time. The method can be practiced at new construction sites, as well as in areas with obstructed access, in a roadless terrain, etc.

The utilization of the disclosed method enables to bring down the cost of soil-testing with the use of a die, to have less costly foundations and above-ground structures, owing to the availability of information on the actual structure and properties of the soil bed.

The herein disclosed method, when used for determining the deformation characteristics of stone-like materials, enables to do with presses and like apparatus of a power output which is a fraction of that previously required, to simplify the testing routine, to test the state of the finished structures and buildings.

Through investigation of the properties of the foundation soil of buildings and structures is a prerequisite of optimizing the engineering solutions, while ensuring the appropriate degree of the service safety and dependability.

What is claimed is:

1. A method of determining the deformation characteristics of construction materials and soil with the use of a die, including the following successively performed steps:

placing said die of a predetermined diameter on the material being tested;

applying an increasing load to said die, to cause the displacement thereof owing to the deformation of said tested material by a value equalling 0.03 to 10.0 diameters of said die;

measuring said displacement of said die;

using the data obtained by said measurement to calculate the modulus of deformation of said material;

gradually relieving the load applied to said die;

measuring the displacement of said die due to the elasticity.

2. A method of determining the deformation characteristics, as set forth in claim 1, wherein, for testing construction materials, said die is loaded to cause its displacement by a value equalling 0.03 to 0.3 diameter of said die.

3. A method of determining the deformation characteristics, as set forth in claim 1, wherein, to test a homogeneous layer of the soil semispace, said die is loaded to cause its displacement by a value equalling 0.05 to 1.0 diameter of said die.

4. A method of determining the deformation characteristics, as set forth in claim 1, wherein, to test a non-homogeneous formation of the soil semispace, said die is loaded to cause its displacement by a value equalling 0.2 to 1.0 diameter of said die, whereafter said die is caused to advance at a rate of 0.001 to 0.1 m/s, while continuously registering the resistance of the formation over a distance equalling 1.0 to 10.0 diameters of said die, whereafter the load applied to said die is relieved, and the displacement of said die due to the elasticity is measured.

5. A method of determining the deformation characteristics, as set forth in claims 3 or 4, wherein the diameter of said die is selected according to the formula:

$$d \geqq \sqrt[3]{k^2 d_1},$$

where

"d" is the diameter of said die,

"$k_1$" is a constant factor,

"$d_1$" is the diameter of the mean weighted particles of the soil, with $d_1 \leqq 0.02$ m.

6. A method of determining the deformation characteristics, as set forth in claim 1, wherein, to test sandy well-filtering soils, said die is caused to advance at a rate of 0.01 to 5.0 m/s over a distance equalling 0.2 to 10.0 diameters of said die.

7. A method of determining the deformation characteristics, as set forth in claim 1, wherein, to test specimens and structural elements of small dimensions, said die is loaded to cause the displacement thereof of a value equalling 0.03 to 1.0 diameter of said die, while limiting the development of the active zone of the deformation to a range satisfying the limiting condition:

$$0.15\ L \leqq D \leqq 1.0\ L,$$

where "L" is the minimum dimension of the specimen, or else the thickness of the structural element;

"D" is the maximum dimension of the active deformation zone.

* * * * *